US006321921B1

(12) United States Patent
Massoudnia

(10) Patent No.: US 6,321,921 B1
(45) Date of Patent: Nov. 27, 2001

(54) FOLDABLE AND STACKABLE RACK

(76) Inventor: Mohammad E. Massoudnia, 15562 Country Ridge, Chesterfield, MO (US) 63107

( * ) Notice: Subject to any disclaimer, the term of this patent is extended or adjusted under 35 U.S.C. 154(b) by 0 days.

(21) Appl. No.: 09/594,973

(22) Filed: Jun. 15, 2000

Related U.S. Application Data

(60) Provisional application No. 60/157,748, filed on Oct. 5, 1999.

(51) Int. Cl.[7] ..... A47F 5/00

(52) U.S. Cl. ..... 211/188; 211/149; 108/125; 108/132; 248/175

(58) Field of Search ..... 211/188, 194, 211/186, 149; 248/439, 175; 108/91, 125, 127, 132

(56) References Cited

U.S. PATENT DOCUMENTS

| | | | | |
|---|---|---|---|---|
| 72,228 | * | 12/1867 | Phillips . | |
| 1,600,823 | | 9/1926 | Hess . | |
| 1,700,843 | * | 2/1929 | Hayward . | |
| 2,707,664 | | 5/1955 | Marsillius | 311/77 |
| 2,708,145 | | 5/1955 | Anderson et al. | 311/77 |
| 2,796,268 | | 6/1957 | Larson | 287/14 |
| 2,844,262 | * | 7/1958 | James . | |
| 2,869,731 | * | 1/1959 | Axelrod . | |
| 3,880,091 | * | 4/1975 | Heinonen . | |
| 4,444,320 | * | 4/1984 | Chap | 211/194 X |
| 4,557,200 | * | 12/1985 | Geschwender | 108/132 |
| 4,732,284 | * | 3/1988 | Remmers | 211/188 |
| 4,915,238 | | 4/1990 | Cassel | 211/37 |
| 4,943,029 | * | 7/1990 | Szuster | 248/175 X |
| 4,953,473 | * | 9/1990 | Tomaka et al. | 108/132 |
| 5,035,335 | | 7/1991 | Massoudnia | 211/188 |
| 5,074,223 | | 12/1991 | Remmers | 108/91 |
| 5,097,971 | | 3/1992 | Norris et al. | 211/181 |
| 5,152,407 | * | 10/1992 | Massoudnia et al. | 211/194 X |
| 5,662,298 | * | 9/1997 | Collins | 108/125 X |

* cited by examiner

*Primary Examiner*—Robert W. Gibson, Jr.
(74) *Attorney, Agent, or Firm*—Senniger, Powers, Leavitt & Roedel

(57) ABSTRACT

A foldable and stackable rack assembly shaped and sized for holding at least one article. The assembly comprises a shelf being sized and shaped for supporting the weight of at least one article. The assembly additionally comprises legs, pivotably attached to the shelf, each leg having a proximal end and a distal end. The proximal end is pivotably attached to the shelf and pivotable between a first position generally perpendicular to the shelf and a second position generally parallel to the shelf. The distal end is formed to engage a horizontal surface to support the shelf when in the first position and alternately allowing the stacking of multiple rack assemblies together. In the stacked configuration, the distal end of each leg engages a second shelf of similar construction, when in the first position, so as to secure a leg of the second shelf in the first position.

19 Claims, 3 Drawing Sheets

FOLDABLE AND STACKABLE RACK

This application claims benefit of provisional No. 60/157,748, filed Oct. 5, 1999.

BACKGROUND OF THE INVENTION

This invention generally relates to racks and more particularly to an improved rack in the form of a foldable and stackable rack for holding articles.

Conventionally, stackable shelves provide a system whereby multiple modular shelving units stack together to form a multiple-shelf rack. These modular units comprise a single shelf with legs, but because the units are stackable, the user can vary the total number of shelves and the height of the rack depending upon the available space and the particular shelving requirements. These shelves typically have legs that extend downward from the shelf. The legs are typically fixed, so that a retailer or user must store the shelf with the legs extended, creating a need for more shelf space to display the item or more storage space to store the item. Moreover, the legs of previous shelves were susceptible to bowing downward, inducing outward movement of the legs when the shelf is subjected to a load. Because previous designs disclosed legs welded to the shelf, deflection of the legs outward created unwanted weld stress, leading to breakage of the weld point and ultimate collapse of the product.

As discussed, prior systems have suffered various drawbacks, including difficulty of display or storage and unwanted outward movement of the legs, which may ultimately lead to collapse of the shelf. There is a need, therefore, for a foldable and stackable shelf that may be compactly stored, inhibits bowing of the legs outward, is easily assembled, and is economical to manufacture.

SUMMARY OF THE INVENTION

Among the several objects and features of the present invention may be noted the provision of a foldable and stackable rack assembly particularly suited for reliably and efficiently holding articles; the provision of such an assembly that can combine multiple shelves into a single assembly for holding articles; the provision of such an assembly that allows storage in a compact configuration; the provision of such an assembly that allows repeated assembly and disassembly without tools; the provision of such an assembly that, once assembled, locks the legs of the interlocking shelves in position; the provision of such an assembly that has legs resistant to collapse when subjected to loading; the provision of such an assembly formed from lightweight materials yet exhibiting good strength characteristics; and the provision of such an assembly that may be easily and economically manufactured.

Generally, a foldable and stackable rack assembly shaped and sized for holding at least one article is disclosed. The assembly comprises a shelf that is sized and shaped for supporting the weight of at least one article. The assembly additionally comprises legs pivotably attached to the shelf. Each leg has a proximal end and a distal end. The proximal end is pivotably attached to the shelf and pivotable between a first position generally perpendicular to the shelf and a second position generally parallel to the shelf. The distal end of each leg is formed to engage a horizontal surface to support the shelf when in the first position. Alternately, the shelf may engage an edge of a second shelf of similar construction when in the first position, thereby allowing the stacking of multiple rack assemblies together wherein the distal ends of the legs each hold and secure a leg of the second shelf in said first position.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
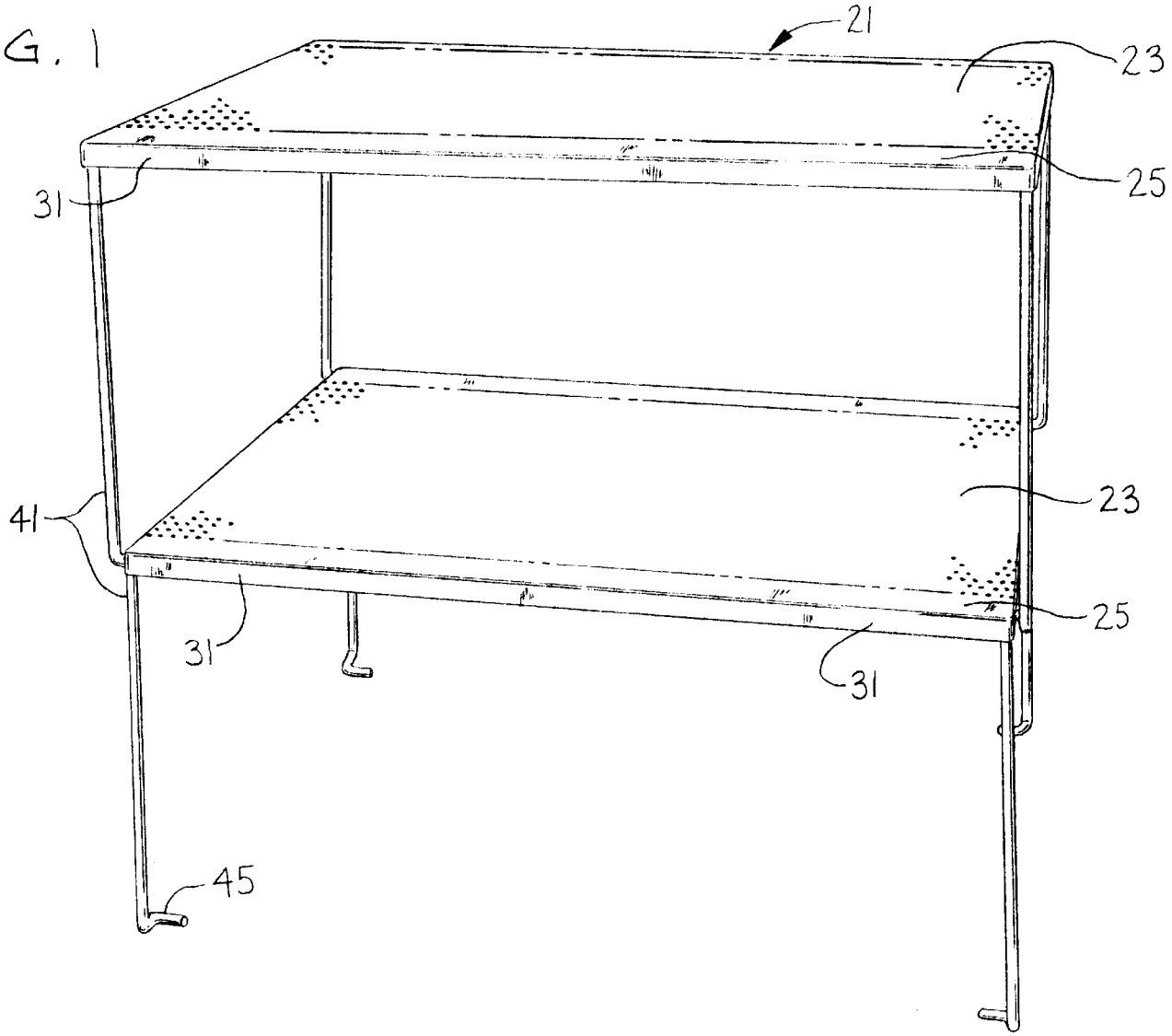
FIG. 1 is a front perspective view of foldable and stackable racks stacked together.

In the illustrated embodiment as shown in FIG. 1, the shelf 21 of a foldable and stackable rack assembly sized and shaped for holding at least one article has an open mesh portion 23 and a solid portion 25. The solid portion 25 and open mesh portion 23 of the shelf 21 may be apportioned or arranged differently than depicted in FIG. 1 without departing from the scope of the invention. For example, the shelf 21 may be entirely solid, the open mesh portion 23 may be a smaller or larger proportion of the total shelf, or the design of the open mesh portion may vary to create different patterns in the mesh. The open mesh portion 23 simplifies cleaning the shelf 21, encourages ventilation, and allows a user to see through a shelf to see what material is on the shelf or ground below. The legs 41 (FIGS. 2–3) are pivotably connected to the solid portion 25. The shelf 21 includes loop hinges 27 and resilient locking tabs 29 formed from the solid portion 25. The shelf 21 has edge portions 31 which protrude downwardly from the margins of the shelf and are perpendicular to the shelf. The edge portions 31 have holes 33 for receiving a foot 45 of another foldable and stackable rack assembly.

Figure 3:
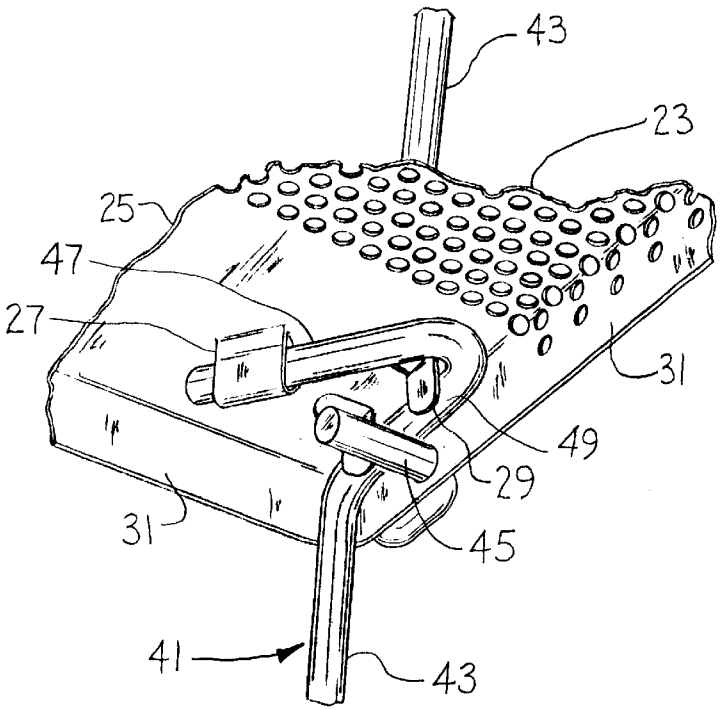
FIG. 3 is an enlarged bottom perspective view of a leg pivoted to the first position generally perpendicular to the shelf and held in place by the foot of an adjacent shelf.

The foldable and stackable rack assemblies may be stacked together, forming a multilevel rack (FIGS. 1 and 3). The foot 45 of each leg 41 is designed to be received within the hole 33 formed in the edge portion 31 of another shelf 21. Therefore, a first rack assembly can receive the legs 41 of a second rack assembly in its holes 33 while its legs are being received by the holes 33 of a third rack assembly. Multiple foldable and stackable rack assemblies may be attached in this manner, forming a multilevel rack.

Figure 2:
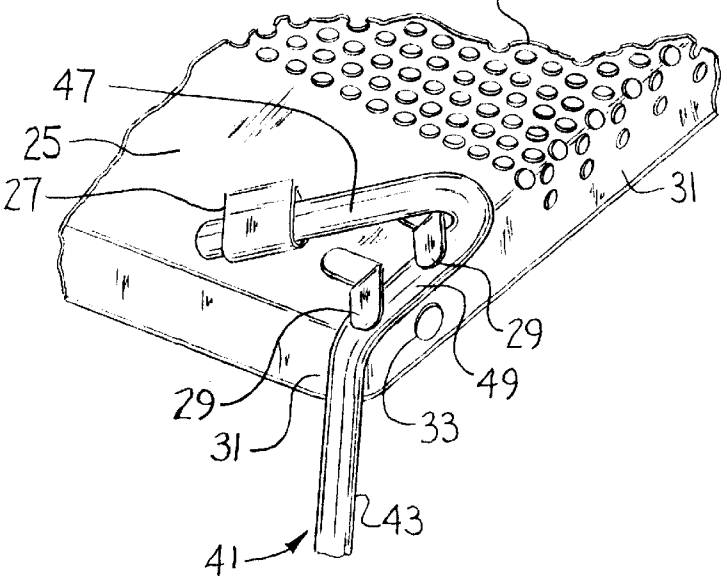
FIG. 2 is an enlarged bottom perspective view of a leg pivoted to a first position generally perpendicular to the shelf.

As shown in FIGS. 1–3, each leg, generally indicated at 41, has a shaft 43, a foot 45, a hinge pin 47, and a shoulder 49. The hinge pin 47 of each leg 41 is pivotably received by the loop hinge 27 of the shelf 21. Each leg 41 is pivotable about the axis of the hinge pin 47 such that the leg may lie generally perpendicular to the shelf 21, a first position, or generally parallel to the shelf, a second position. FIG. 2 depicts a leg 41 pivoted to be perpendicular to the shelf 21 in a first position. In this first position, the shoulder 49 of each leg 41 creates an interference fit between a pair of adjacent locking tabs 29 and the edge portion 31 of the shelf 21. Furthermore, the legs 41 are angled outward slightly from vertical, as viewed from the front (FIG. 1). As the load increases, the legs 41 firmly seat in their locked position as the forces directed through the leg act vertically to the outside of the loop hinge 27, holding the shoulder 49 of the leg firmly against the shelf 21. Finally, the foot 45 assists in holding the leg 41 in the first position. As pressure increases and the lower portions of the legs attempt to flex outward due to their slight outward angle from vertical, the inward facing foot 45 presses into the surface where the shelf 21 sits, thereby stopping any movement of the leg 41 that could compromise the position and stability of the leg (FIG. 1). Due to the releasable interference fit of the leg between the locking tabs 29 and edge portions 31, the design of the leg 41 angle, and the inward facing foot 45, the entire apparatus can support a load without the legs buckling or sliding out of position.

As shown in FIG. 3, when the foot 45 of an adjacent rack assembly is inserted in the hole 33, the foot fits beneath the shoulder 49 of the lower rack's leg 41, holding and locking the lower leg in a first position generally perpendicular to the shelf 21. This feature further ensures that the apparatus can support a load without the legs 41 buckling or sliding out of position. To insert the foot 45 into the hole 33 of an adjacent rack assembly, the leg 41 of the upper rack must flex slightly outward to provide adequate clearance before the foot will slide into the corresponding hole. Once the foot 45 is partially within the hole, the leg 41 will relax to its original position, pushing the foot fully into the hole 33. The inherent inward spring force of the legs 41, created by their tendency to return to their original position, holds the feet 45 firmly within the holes.

Figure 4:
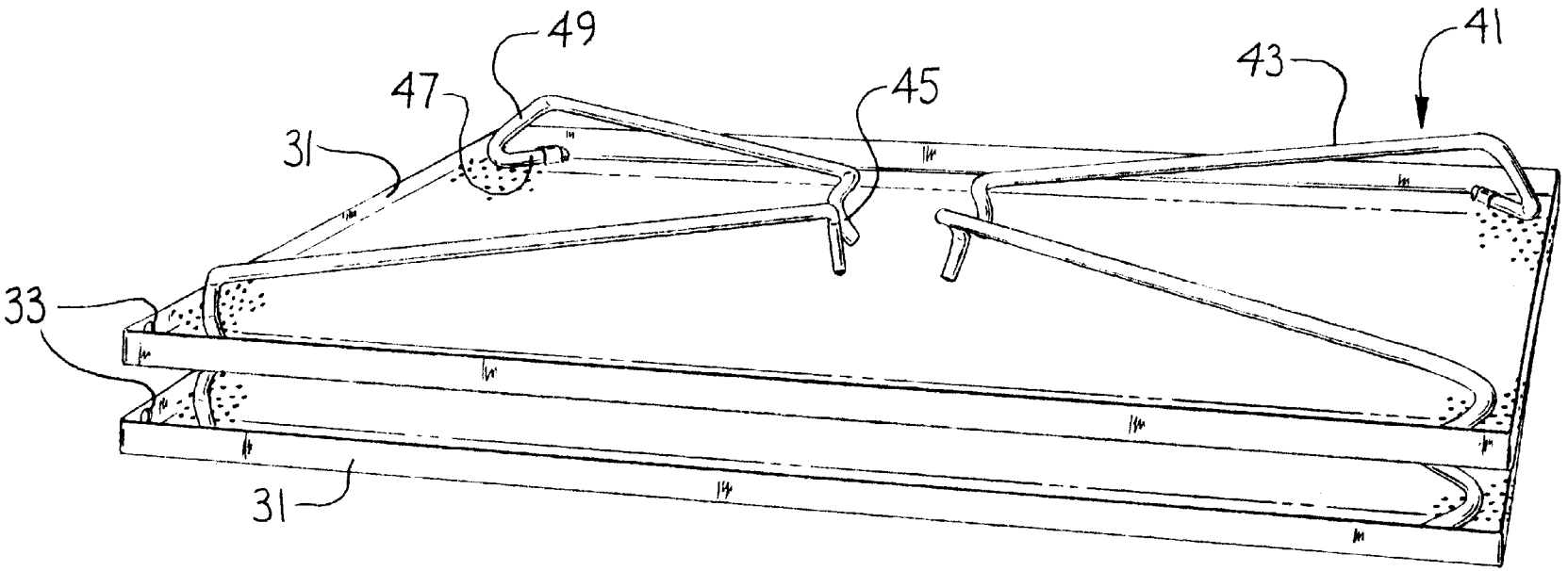
FIG. 4 is a front perspective view of foldable and stackable racks collapsed to a second position and stacked adjacent one another.

FIG. 4 shows the stacking capabilities of the present invention. Each leg 41 can fold to a second position generally parallel to a shelf 21. Each shelf 21 then becomes more compact, allowing for compact storage of the shelf. This compact stacking is advantageous. Retailers will appreciate the compact nature of the racks when displaying them for sale, while users will appreciate the compact design when storing or transporting the racks.

One skilled in the relevant art should understand that the shelf 21, legs 41, and other features and components of the present invention described herein may be formed of various materials, from varying numbers of parts, and with varying sizes, without departing from the scope of the invention. For instance, the shelf 21 may be made from a non-metallic material, like wood, while having loop hinges 27, tabs 29, and legs 41 all formed from metal and attached to the wooden shelf. In the preferred embodiment, the shelf 21 is steel, or another suitable metal. Additionally in the preferred embodiment, the cylindrical legs 41 are formed from metallic rod bent into the proper shape for attachment to and pivotable movement with the shelf 21.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. A foldable and stackable rack assembly shaped and sized for holding at least one article, said assembly comprising:

a shelf for supporting said at least one article, the shelf being sized and shaped for supporting the weight of said at least one article; and legs pivotably attached to the shelf, each leg having a proximal end and a distal end, said proximal end being pivotably attached to the shelf and pivotable between a first position generally perpendicular to the shelf and a second position generally parallel to the shelf, said distal end being formed to engage a horizontal surface to support the shelf when in the first position and alternately allowing the stacking of multiple rack assemblies together, wherein the distal end of each leg engages a second shelf of similar construction when in the first position so as to secure a leg of the second shelf in said first position.

2. A foldable and stackable rack assembly as set forth in claim 1 wherein each said distal end has an extension engageable with an edge of the second shelf.

3. A foldable and stackable rack assembly as set forth in claim 2 wherein each said extension extends laterally at substantially a right angle to the leg and inwardly such that the extension is directed beneath the foldable and stackable rack assembly.

4. A foldable and stackable rack assembly as set forth in claim 3 wherein the extension is a cylindrical post.

5. A foldable and stackable rack assembly as set forth in claim 4 wherein the post is sized and shaped for insertion into a hole in the second shelf.

6. A foldable and stackable rack assembly as set forth in claim 5 wherein the posts are insertable into the hole so that the post fits beneath a shoulder of a leg of the second shelf, thereby securing the leg in a first position.

7. A foldable and stackable rack assembly as set forth in claim 5 wherein the inherent inward spring force of the legs holds the posts within the holes.

8. A foldable and stackable rack assembly as set forth in claim 1 wherein said legs are of unitary construction.

9. A foldable and stackable rack assembly as set forth in claim 8 further comprising a hinge pin integrally formed with the legs and received by a hinge for pivotable movement of the pin within the hinge and pivotable movement of the leg about the hinge.

10. A foldable and stackable rack assembly as set forth in claim 9 wherein the hinge is formed from a loop of metallic material.

11. A foldable and stackable rack assembly as set forth in claim 8 wherein the proximal end of the leg has a shoulder that limits movement of the leg such that the leg cannot be pivoted past a point substantially perpendicular to the shelf.

12. A foldable and stackable rack assembly as set forth in claim 11 wherein the shoulder has an interference fit with the shelf to hold the shoulder in place and the leg in the first position.

13. A foldable and stackable rack assembly as set forth in claim 12 further comprising at least one tab for engaging the shoulder to create an interference fit.

14. A foldable and stackable rack assembly as set forth in claim 13 wherein said at least one tab is integrally formed with the shelf.

15. A foldable and stackable rack assembly as set forth in claim 1 wherein the shelf has an open mesh portion and a solid portion.

16. A foldable and stackable rack assembly as set forth in claim 1 wherein the shelf has turned-down edges for strengthening the shelf and engaging the distal end of the legs.

17. A foldable and stackable rack assembly shaped and sized for holding at least one article, said assembly comprising:

a shelf for supporting said at least one article, the shelf being sized and shaped for supporting the weight of said at least one article; and legs pivotably attached to the shelf, each leg having a proximal end and a distal end, said proximal end being pivotably attached to the shelf and pivotable between a first position generally perpendicular to the shelf and a second position generally parallel to the shelf, said distal end being an inwardly directed cylindrical post to engage a horizontal surface to support the shelf when in the first position, the inward orientation of the distal end inhibiting the leg from flexing outward as the shelf bears the load of the article.

18. A foldable and stackable rack assembly as set forth in claim 17 wherein the cylindrical posts can engage an edge of a second shelf of similar construction when in the first position, thereby allowing the stacking of multiple rack assemblies together so that the posts of the legs each hold and secure a leg of the second shelf in said first position, said posts are insertable into a set of holes formed in the second shelf and fit beneath a shoulder of the legs of the second shelf, securing said legs in a first position.

19. A foldable and stackable rack assembly as set forth in claim 17 wherein the inward spring force of the legs holds the posts within the holes.

* * * * *